US006962540B2

(12) United States Patent
Sato et al.

(10) Patent No.: US 6,962,540 B2
(45) Date of Patent: Nov. 8, 2005

(54) GOLF BALL AND DIMPLE FORMATION

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 110 days.

(21) Appl. No.: 10/820,001

(22) Filed: Apr. 8, 2004

(65) Prior Publication Data

US 2004/0209709 A1 Oct. 21, 2004

(30) Foreign Application Priority Data

Apr. 18, 2003 (JP) ..... 2003-114261

(51) Int. Cl.[7] ..... A63B 37/12
(52) U.S. Cl. ..... 473/383
(58) Field of Search ..... 473/378–385

(56) References Cited

U.S. PATENT DOCUMENTS 6,595,876 B2 7/2003 Kasashima et al.

FOREIGN PATENT DOCUMENTS

JP 2001-212260 A 8/2001

*Primary Examiner*—Raeann Gorden
(74) *Attorney, Agent, or Firm*—Sughrue Mion, PLLC

(57) ABSTRACT

In a golf ball having a multiplicity of generally circular dimples on its outer surface, the number of those dimples having a neighbor relationship that satisfies $|\alpha-\beta| \geqq 15°$ wherein $\beta$ is an angle included between two line segments extending from the center of a reference dimple tangent to the rim of an adjacent dimple and $\alpha$ is an angle included between two line segments extending from the center of the adjacent dimple tangent to the rim of the reference dimple is at least 60% of the total number of dimples. This enhances the dimple effects, so the ball exhibits improved aerodynamic performance and offers a consistent carry and direction independent of the point of impact.

8 Claims, 6 Drawing Sheets

GOLF BALL AND DIMPLE FORMATION

BACKGROUND OF THE INVENTION

1. Technical Field

This invention relates to a dimpled golf ball featuring aerodynamic isotropy, excellent flight performance and consistent carry and a method of forming dimples on a golf ball.

2. Background Art

In the traditional golf ball art, when dimples are distributed on the outer surface of a golf ball, spherical polyhedral arrangements, typically spherical octahedral and spherical icosahedral and random arrangements have been utilized from the standpoint of uniform arrangement, as referred to U.S. Pat. No. 6,595,876. A typical arrangement process involves dividing a spherical surface into regular polyhedral faces to define unit triangles, disposing dimples in each unit triangle in good balance, and assigning the unit triangles to the eight divided faces on the spherical surface in the case of a regular octahedron, for example. Such dimple arrangements facilitate the design of dimples and the manufacture of a golf ball manufacturing mold and are effective for providing better aerodynamic properties.

However, the dimple arrangement tends to lack continuity at or in proximity to those areas corresponding to the sides where unit triangles are joined together and an equatorial area in register with the parting plane of a golf ball mold. A golf ball lacking continuity or balance in its dimple arrangement can develop different aerodynamic properties depending on the position of a spinning axis, and thus travel a varying distance depending on the point of impact on the ball. Specifically, the golf ball when hit develops different aerodynamic properties and different spin rates, depending on whether the golf ball spins parallel to the side of a unit triangle or the equator of the ball or spins at a certain angle with respect to the unit triangle side or the equator. Then the trajectory of the ball is subject to variations in vertical and horizontal directions, resulting in variations of carry and direction.

While improvements in aerodynamic properties are requisite for a golf ball to exert favorable flight performance, it is believed that the optimization of dimple arrangement reduces the variation during flight and improves the aerodynamic performance.

There exists a demand for a golf ball which when hit, exhibits improved aerodynamic properties and minimized variations of carry and direction independent of the spinning axis.

SUMMARY OF THE INVENTION

An object of the invention is to provide a golf ball in which some parameters relating to the size and location of neighboring dimples are optimized to enhance the effects of dimples for improving aerodynamic performance, thereby offering a consistent carry and direction independent of the point of impact. Another object is to provide a method of forming dimples on a golf ball.

Regarding a golf ball having on its outer surface a multiplicity of dimples which are generally circular as viewed in plane, the inventors have found that the ball exhibits improved aerodynamic performance and offers a consistent carry (or flight distance) and direction independent of the point of impact when the number of those dimples having a neighbor relationship that a reference dimple arbitrarily selected from the multiplicity of dimples and an adjacent dimple disposed adjacent to the reference dimple are correlated so as to satisfy $|\alpha-\beta| \geqq 15°$ wherein $\alpha$ is an angle included between two line segments drawn from the center of the adjacent dimple tangent to the rim of the reference dimple and $\beta$ is an angle included between two line segments drawn from the center of the reference dimple tangent to the rim of the adjacent dimple is at least 60% of the total number of dimples.

In one aspect, the present invention provides a golf ball having on its outer surface a multiplicity of dimples which are generally circular as viewed in plane and which each have a center and a peripheral rim. The number of those dimples having a neighbor relationship provided that a reference dimple is arbitrarily selected from the multiplicity of dimples and an adjacent dimple is disposed adjacent to the reference dimple, an angle $\alpha$ included between two line segments drawn from the center of the adjacent dimple tangent to the rim of the reference dimple and an angle $\beta$ included between two line segments drawn from the center of the reference dimple tangent to the rim of the adjacent dimple satisfy $|\alpha-\beta| \geqq 15°$ is at least 60% of the total number of dimples.

In a preferred embodiment, the number of those dimples having a neighbor relationship that the linear distance between the center of the reference dimple and the center of the adjacent dimple is at least 4 mm is at least 80% of the total number of dimples. Most often, there are dimples of at least three types which differ in size. In a preferred embodiment, the number of those dimples whose rim has a peripheral length of at least 13 mm is at least 70% of the total number of dimples.

In another aspect, the present invention provides a method of forming on the outer surface of a golf ball a multiplicity of dimples which are generally circular as viewed in plane and which each have a center and a peripheral rim. The method comprises designing and arranging the dimples such that the number of those dimples having a neighbor relationship provided that a reference dimple is arbitrarily selected from the multiplicity of dimples and an adjacent dimple is disposed adjacent to the reference dimple, an angle $\alpha$ included between two line segments drawn from the center of the adjacent dimple tangent to the rim of the reference dimple and an angle $\beta$ included between two line segments drawn from the center of the reference dimple tangent to the rim of the adjacent dimple satisfy $|\alpha-\beta| \geqq 15°$ is at least 60% of the total number of dimples.

In a preferred embodiment, the dimples are designed and arranged such that the number of those dimples having a neighbor relationship that the linear distance between the center of the reference dimple and the center of the adjacent dimple is at least 4 mm is at least 80% of the total number of dimples. Most often, there are dimples of at least three types which differ in size. In a preferred embodiment, the dimples are designed and arranged such that the number of those dimples whose rim has a peripheral length of at least 13 mm is at least 70% of the total number of dimples.

DESCRIPTION OF THE PREFERRED EMBODIMENTS

The golf ball of the invention has on its outer surface a multiplicity of dimples which are generally circular as viewed in plane and which each have a center and a peripheral rim. The term "generally circular" is used to include not only a circular shape, but also modified circular shapes such as elliptic, race track, egg and teardrop shapes, as viewed in plane.

For the definition of a neighbor relationship of dimples, attention is paid to a reference dimple which is arbitrarily selected from the multiplicity of dimples and an adjacent dimple which is disposed adjacent to the reference dimple. Then an angle $\alpha$ is included between two line segments drawn from the center of the adjacent dimple tangent to the rim of the reference dimple and an angle $\beta$ is included between two line segments drawn from the center of the reference dimple tangent to the rim of the adjacent dimple. According to the invention, the number of those dimples having a neighbor relationship satisfying $|\alpha-\beta| \geqq 15°$ is at least 60% of the total number of dimples.

The term "adjacent dimple" is defined as follows. In a relationship of an arbitrary reference dimple and a plurality of neighboring dimples disposed to surround the reference dimple, polygonal regions are defined by perpendicular bisectors to line segments connecting the center of the reference dimple to the center of neighboring dimples, and among them, there is a minimum polygonal region surrounding the reference dimple. Those neighboring dimples from which the perpendicular bisectors used to define the minimum polygonal region are derived are the "adjacent dimples" disposed adjacent to the reference dimple.

Figure 1:
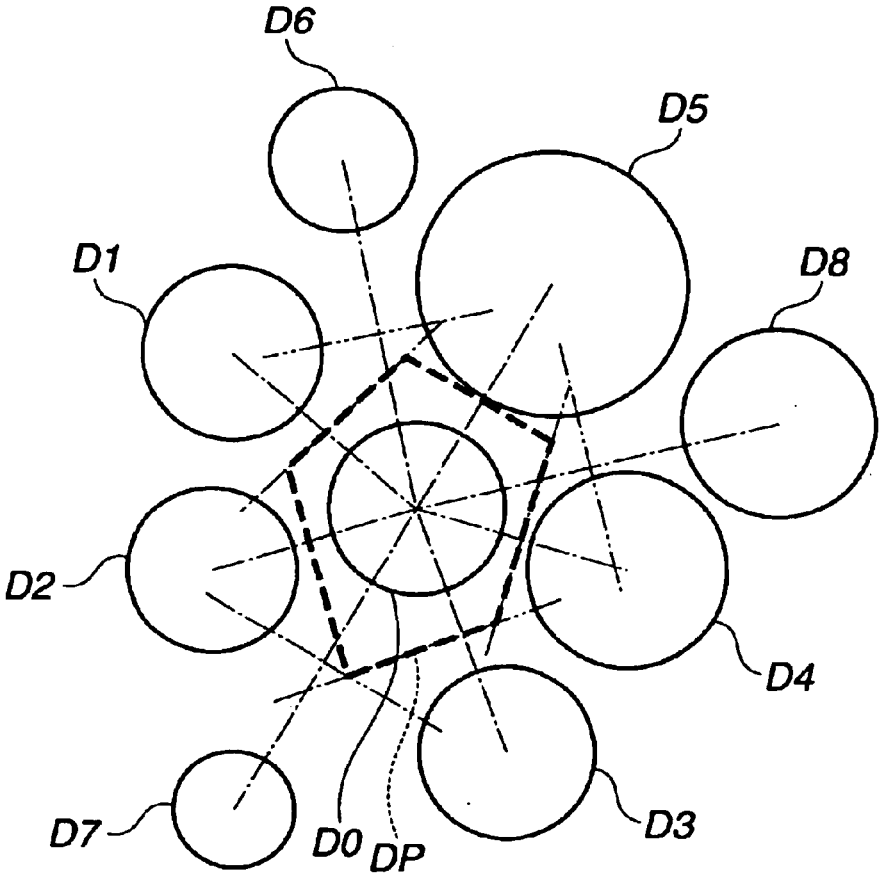
FIG. 1 is a schematic view of an arbitrary reference dimple and adjacent dimples for illustrating their neighbor relationship.

This will be readily understood from FIG. 1 that illustrates the neighbor relationship of one reference dimple which is arbitrarily selected from among a multiplicity of dimples formed on the outer surface of a golf ball and neighboring dimples which are disposed to surround the reference dimple. In FIG. 1, there are illustrated an arbitrarily selected reference dimple D0 and a plurality of neighboring dimples D1, D2, D3, D4, D5, D6, D7 and D8 which are disposed to surround the reference dimple D0. Polygonal regions are defined by perpendicular bisectors (depicted by dot-and-dash lines) to line segments (depicted by dot lines) connecting the center of the reference dimple D0 to the center of neighboring dimples D1, D2, D3, D4, D5, D6, D7 and D8. Among them, there is a minimum polygonal region surrounding the reference dimple D0, which is referred to as a minimum polygonal cylinder region DP (depicted by thick dot-and-dash lines).

Those neighboring dimples D1, D2, D3, D4 and D5 from which the perpendicular bisectors used to define the minimum polygonal cylinder region DP are derived are the "adjacent dimples" disposed adjacent to the reference dimple D0. In FIG. 1, dimples D6, D7 and D8 are not adjacent dimples because their perpendicular bisectors do not participate in the minimum polygonal cylinder region DP.

The (peripheral) "rim" of a dimple is the highest point of the dimple that connects to the land of the golf ball surface (where no dimples are formed).

Figure 2:
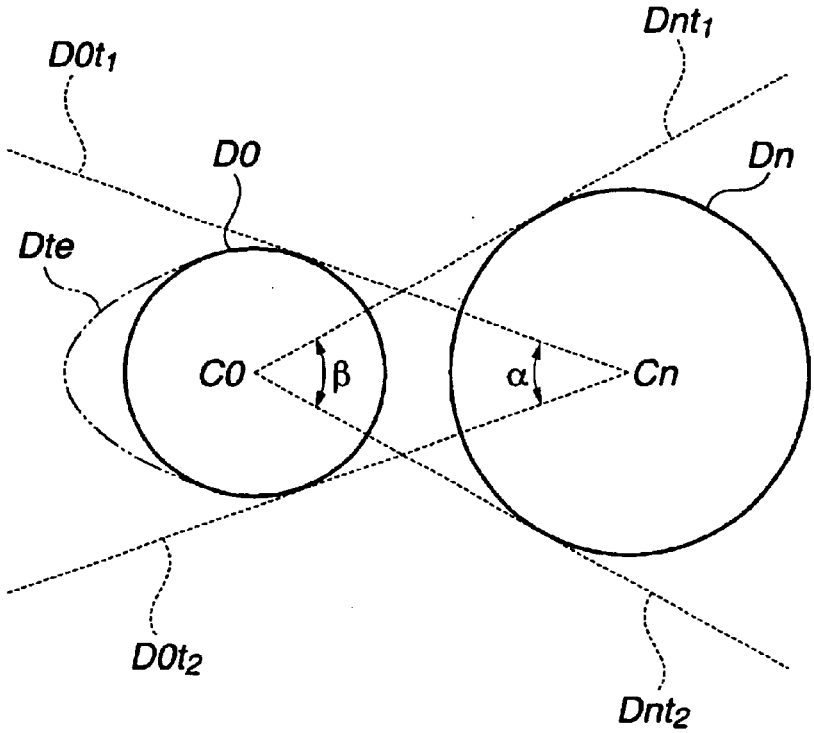
FIG. 2 schematically illustrates angles $\alpha$ and $\beta$ associated with a pair of neighboring dimples.

FIG. 2 illustrates the neighbor relationship of a reference dimple D0 to an adjacent dimple Dn. An angle $\alpha$ is included between two tangents $D0t_1$ and $D0t_2$ passing the center Cn of the adjacent dimple Dn and extending tangent to the rim of the reference dimple D0, and an angle $\beta$ is included between two tangents $Dnt_1$ and $Dnt_2$ passing the center C0 of the reference dimple D0 and extending tangent to the rim of the adjacent dimple Dn.

In the invention, the absolute value $|\alpha-\beta|$ of the difference between angles $\alpha$ and $\beta$ is of significance, and preferably at least 15 degrees.

In the invention, the number of those dimples having a neighbor relationship $|\alpha-\beta| \geqq 15°$ is at least 60%, preferably at least 65% of the total number of dimples on the golf ball surface while the upper limit is usually up to 100%, preferably up to 90%. If the number of those dimples having a neighbor relationship $|\alpha-\beta| \geqq 15°$ is less than 60% of the total number of dimples on the golf ball surface, too many dimples of approximate size are included, failing to attain the object of the invention from the aerodynamic standpoint. The maximum value of $|\alpha-\beta|$ is about 45° for practical reasons, but not limited thereto.

In FIG. 2, both the rim of reference dimple D0 and the rim of adjacent dimple Dn are depicted by solid lines as having a circular shape in plan view. However, the shape of the dimple rim is not particularly limited as long as the shape provides $\alpha$ and $\beta$ values satisfying the above relationship. For example, a teardrop shape depicted by dot-and-dash lines in FIG. 2 is acceptable as the rim of a generally circular shape dimple. Since the rim shape of a dimple Dte is a teardrop shape consisting of an arcuate portion fused to an oval portion as shown in FIG. 2, the center C0 of the arcuate portion is regarded as the substantial center of that dimple. Then $\alpha$ and $\beta$ values can be similarly determined, from which the value of $|\alpha-\beta|$ is computed.

In the invention, the linear distance between the center of an arbitrary reference dimple and the center of an adjacent dimple as defined above is not particularly limited. In a preferred embodiment, the number of those dimples having a neighbor relationship that the linear distance between the center of the reference dimple and the center of the adjacent dimple is at least 4 mm is at least 80%, more preferably at least 90% of the total number of dimples. In the embodiment wherein the number of those dimples having a neighbor relationship that the distance between the centers of reference and adjacent dimples is at least 4 mm is at least 80% of the total number of dimples, even when dimples of three or more types which differ in size are juxtaposed, there is a more definite difference between the sizes of dimples. Differently stated, there is a contrast in size between the neighboring dimples. At the same time, a relatively small total number of dimples can be uniformly arranged on the ball surface at a high density. The term "dimples of plural types which differ in size" means that dimples differ in diameter when they are circular. If the number of those dimples having a neighbor relationship that the linear distance between the centers of neighboring dimples (in at least a non-overlapping relation) is at least 4 mm is less than 80% of the total number of dimples or if those dimples having a neighbor relationship that the linear distance between the centers of neighboring dimples is less than 4 mm are used in a large number, for example, at least 80% of the total number of dimples, then there may arise a situation where small diameter dimples are disposed adjacent to each other, resulting in an increased total number of dimples. This situation is scarcely distinguishable from the conventional dimple arrangement, often failing to attain the object of the invention. In practice, the distance between the centers of neighboring dimples is 6 mm at maximum.

The dimples generally have a depth of at least 0.1 mm, preferably at least 0.15 mm, with the upper limit of depth being up to 0.5 mm, preferably up to 0.35 mm. Dimples with a depth of less than 0.1 mm may fail to exert the desired effects whereas dimples with a depth of more than 0.5 mm may create an air resistance. It is noted that the depth of a dimple is a radial distance between the surface of a phantom sphere (provided the cover surface is free of dimples) and the deepest bottom of the dimple.

The types of dimples on the golf ball surface are preferably three to six types which differ in diameter or peripheral length. Preferably the number of those dimples whose rim has a peripheral length of at least 13 mm is at least 70% of the total number of dimples. If the number of those dimples whose rim has a peripheral length of at least 13 mm is less than 70% of the total number of dimples, it causes that an increased number of dimples of smaller size or diameter is used, so that an attempt to arrange dimples in a higher density results in an increased total number of dimples. This situation is scarcely distinguishable from the conventional dimple arrangement. The upper limit of peripheral length is usually up to 19 mm.

The total number of dimples on the golf ball surface is generally up to 350, preferably up to 300, and the lower limit is generally at least 200, preferably at least 250. If the total number of dimples is more than 350, the dimple arrangement may be scarcely distinguished from the conventional one. If the total number of dimples is less than 200, the ball may lose sphericity somewhat or have an increased land area where no dimples are formed, depending on the size of dimples. Either case may fail to attain the object of the invention.

In conjunction with the golf ball of the invention, a phantom sphere is given on the assumption that the cover surface is free of dimples, and a dimple space is defined between a dimple concave wall and the surface of the phantom sphere. Then a dimple space volume proportion VR (%), which is defined as the total of the volumes of dimple spaces divided by the overall volume of the phantom sphere, is preferably at least 0.6%, more preferably at least 0.7% and preferably up to 0.9%, more preferably up to 0.85%, though not particularly limited thereto.

The dimple forming method of the invention is directed to a golf ball having a multiplicity of dimples which are generally circular as viewed in plane and intended to form dimples on the golf ball so that the golf ball when hit may exhibit improved aerodynamic performance and offer a consistent carry and direction independent of the spinning axis. The method involves designing and arranging the dimples such that the number of those dimples having a neighbor relationship that an angle $\alpha$ included between two line segments drawn from the center of an adjacent dimple tangent to the rim of an arbitrary reference dimple and an angle $\beta$ included between two line segments drawn from the center of the reference dimple tangent to the rim of the adjacent dimple satisfy $|\alpha-\beta| \geqq 15°$ is at least 60% of the total number of dimples. By providing dimples on the golf ball outer surface in this way, a relatively small total number of dimples can be distributed in a high density and good balance, ensuring that the golf ball when hit exhibits improved aerodynamic performance and offers a consistent carry and direction independent of the spinning axis.

In distributing dimples on the spherical surface according to the inventive method, a spherical polyhedral arrangement such as icosahedral, dodecahedral or octahedral may be utilized.

The internal structure of the inventive golf ball is not critical and any well-known internal structure may be used. For example, it may be a two-piece golf ball consisting of a core and a cover, or a multi-piece golf ball consisting of a core, an intermediate layer and a cover of one or more layers. The core may be either a thread wound core or a solid core.

There has been described a golf ball in which dimples are optimized to enhance their effects for improving aerodynamic performance, thereby offering a consistent carry and direction independent of the point of impact.

EXAMPLE

Examples of the invention are given below by way of illustration and not by way of limitation.

Examples 1–3 and Comparative Example 1

The golf balls of Examples 1 to 3 and Comparative Example 1 were solid golf balls of three-layer structure including a monolithic core of rubber, a single intermediate layer of a composition comprising an ionomer resin and an olefinic elastomer, and a cover of polyurethane elastomer. In all the Examples and Comparative Example, the intermediate layer had a gage of 1.65 mm and a Shore D hardness of 61 as measured on the surface of the intermediate layer enclosing the core; the cover had a gage of 1.5 mm and a Shore D hardness of 58 as measured on the land of the ball surface.

Table 1 shows various parameters relating to dimples formed on the outer surface of the golf balls of Examples 1 to 3 and Comparative Example 1. The arrangements of several types of dimples on the surface of the golf balls of Examples 1 to 3 and Comparative Example 1 are shown in FIGS. 3 to 6, respectively.

Figure 3:
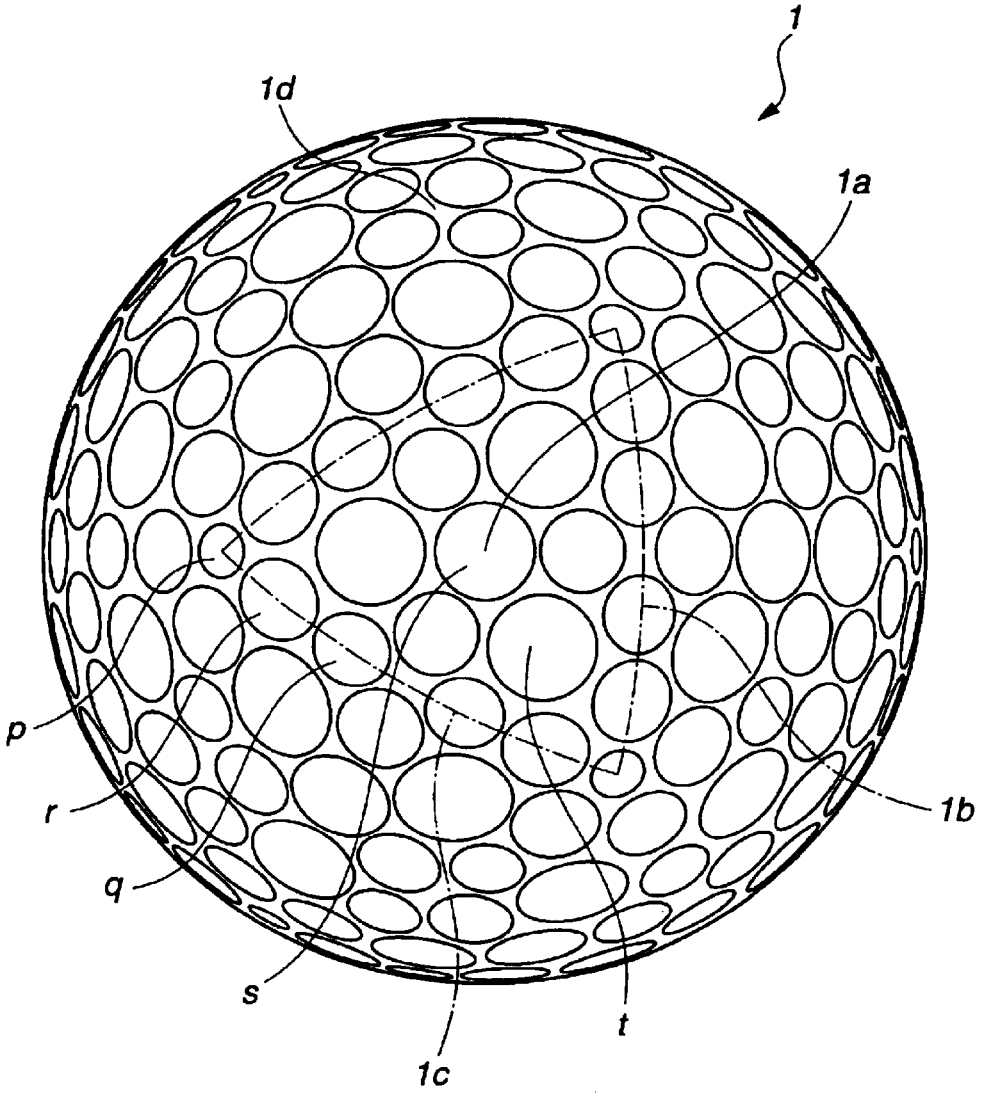
FIG. 3 is a schematic plan view of a golf ball in one embodiment of the invention.
Figure 4:
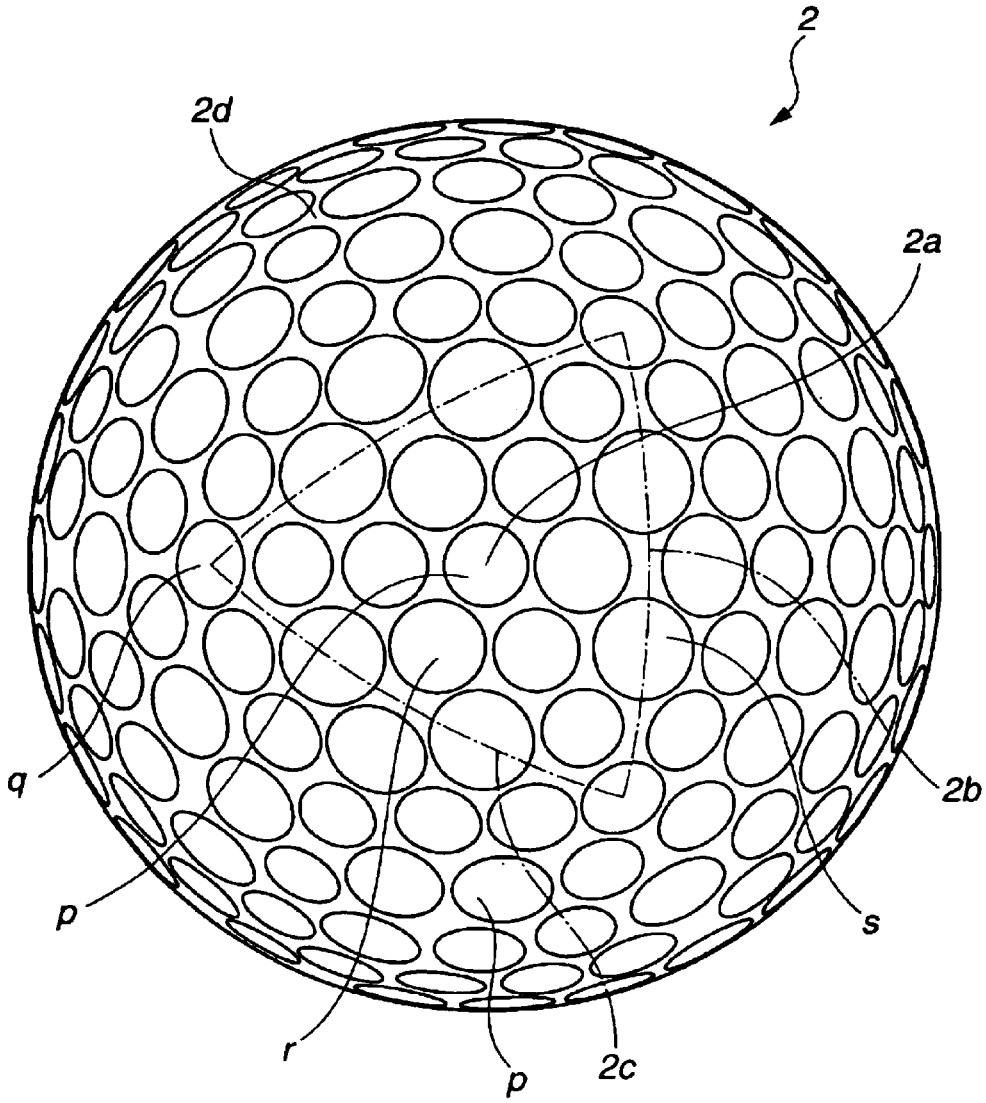
FIG. 4 is a schematic plan view of a golf ball in another embodiment of the invention.
Figure 5:
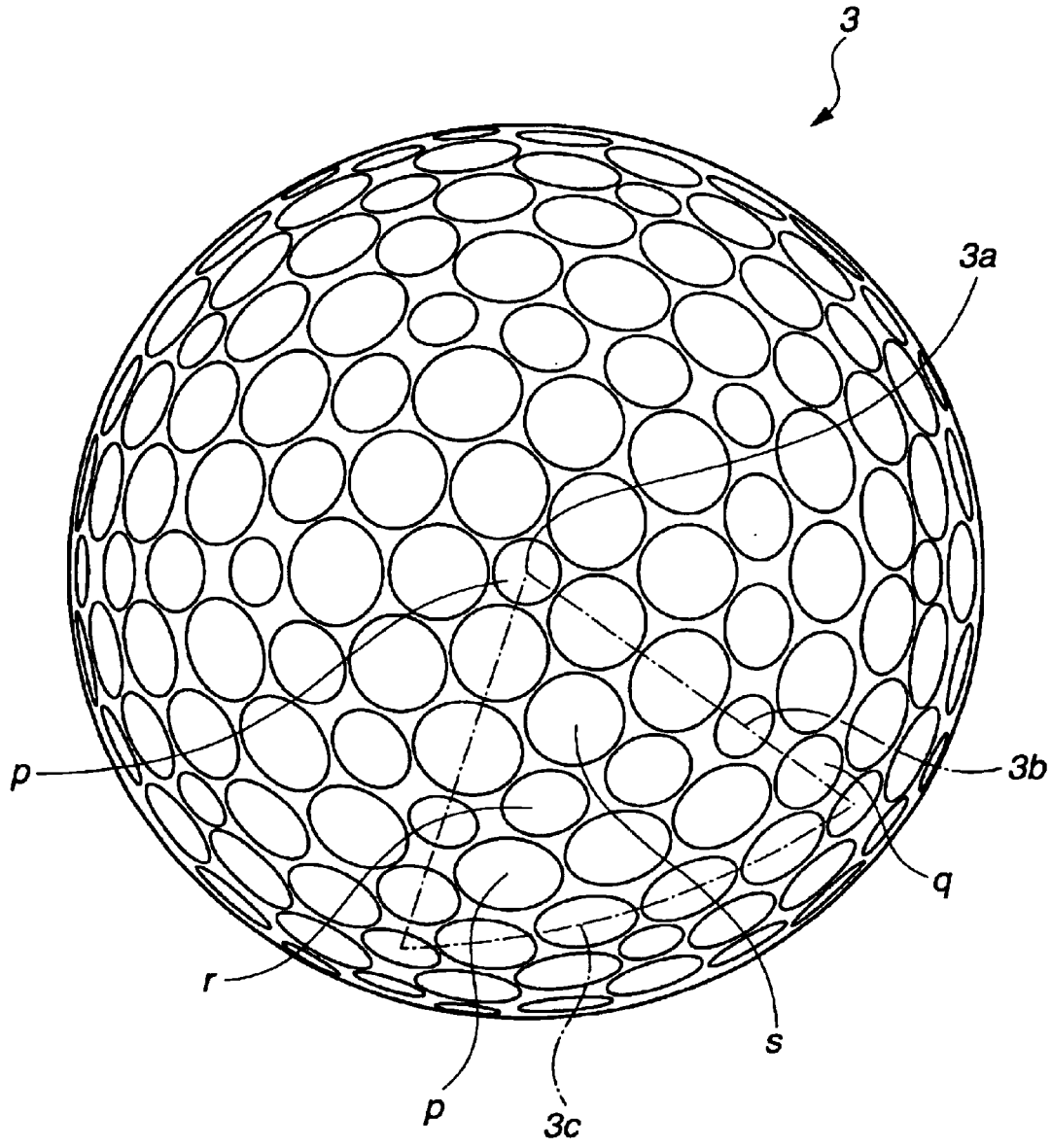
FIG. 5 is a schematic plan view of a golf ball in a further embodiment of the invention.
Figure 6:
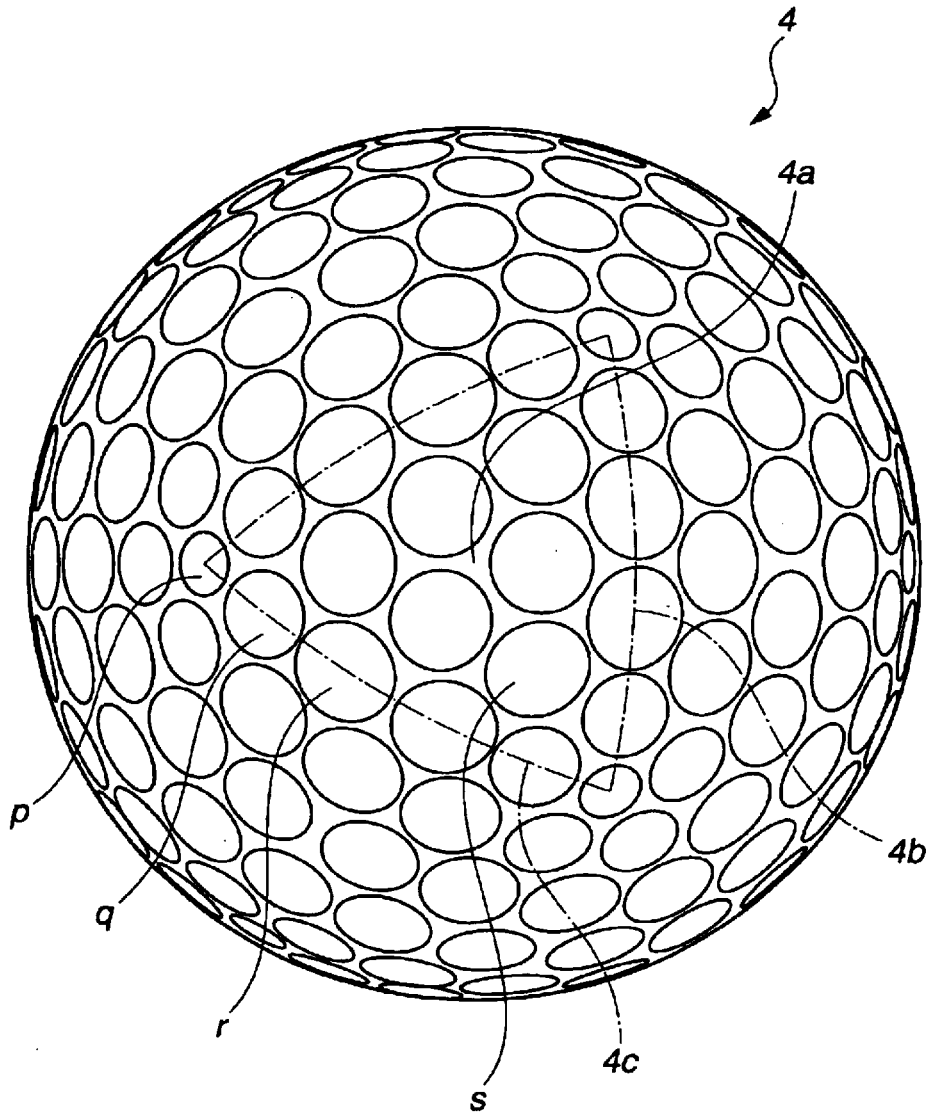
FIG. 6 is a schematic plan view of a prior art golf ball.

FIGS. 3 to 5 are schematic plan views of the golf balls in different embodiments of the invention as viewed from above their pole, and FIG. 6 is a schematic plan view of the comparative golf ball. In FIGS. 3 to 6 and Table 1, all the dimples are circular dimples, and they are designated by p, q, r, s and t in the ascending order of size (diameter). In Example 1 (FIG. 3), five types of dimples differing in diameter are used. In Examples 2 and 3 and Comparative Example 1 (FIGS. 4, 5 and 6), four types of dimples are used likewise. Specifically, five types of dimples p, q, r, s and t used in FIG. 3, or four types of dimples p, q, r and s used in FIG. 4 are arranged in good balance within a unit triangle 1*b*, 2*b* centered at the pole 1*a*, 2*a* of the golf ball, and on sides 1*c*, 2*c* of that unit triangle. It is noted that those portions of the golf ball outer surface where no dimples are arranged are lands 1*d*, 2*d*. In FIG. 5, dimples of different sizes are arranged in good balance within a unit triangle 3*b* having one apex at the pole 3*a* of the golf ball, and on sides 3*c* of that unit triangle.

TABLE 1

| | | Example | | | Comparative Example |
|---|---|---|---|---|---|
| Dimples | | 1 | 2 | 3 | 1 |
| Arrangement pattern | | FIG. 3 | FIG. 4 | FIG. 5 | FIG. 6 |
| Diameter, mm | Dimple p (number) | 2.8 ( 12) | 3.9 ( 20) | 3.3 ( 32) | 3.2 ( 12) |
| | Dimple q (number) | 4.0 ( 60) | 4.1 (132) | 4.1 ( 60) | 4.3 ( 60) |
| | Dimple r (number) | 4.5 (120) | 4.7 ( 60) | 4.9 (120) | 4.8 ( 54) |
| | Dimple s (number) | 5.2 ( 20) | 5.2 ( 60) | 5.2 ( 60) | 5.0 (126) |
| | Dimple t (number) | 5.7 ( 60) | — | — | — |
| Total number | | 272 | 272 | 272 | 272 |
| Proportion of dimples satisfying $\lvert\alpha - \beta\rvert \geqq 15°$, % | | 89 | 66 | 78 | 28 |

TABLE 1-continued

| | Example | | | Comparative Example |
|---|---|---|---|---|
| Dimples | 1 | 2 | 3 | 1 |
| Proportion of dimples satisfying center distance ≧ 4 mm, % | 96 | 100 | 100 | 96 |
| VR, % | 0.8 | 0.8 | 0.8 | 0.8 |

Diameter (mm)

The diameter of a circular shape delimited by the rim of a dimple

Proportion (%) of Dimples Satisfying $|\alpha-\beta| \geqq 15°$

It is the number of those dimples having a neighbor relationship $|\alpha-\beta| \geqq 15°$ wherein a is an angle included between two line segments drawn from the center of an adjacent dimple tangent to the rim of an arbitrary reference dimple and β is an angle included between two line segments drawn from the center of the reference dimple tangent to the rim of the adjacent dimple, relative to the total number of dimples.

Proportion (%) of Dimples Satisfying Center Distance≧4 mm

It is the number of those dimples having a neighbor relationship that the distance between the centers of an arbitrary reference dimple and an adjacent dimple is at least 4 mm, relative to the total number of dimples.

VR (%)

A dimple space volume proportion is the total of the volumes of dimple spaces each defined between a dimple concave wall and the surface of a phantom sphere given on the assumption that the cover surface is free of dimples, relative to the volume of the phantom sphere.

In a test, the golf balls were hit whereupon a carry (m) and a total distance (m) were measured. In the test, a hitting machine was equipped with a driver (W#1) and operated at a head speed of 45 m/s and a launch angle of 10°.

In each of Examples and Comparative Example, five balls were tested. The carry (m) or total (m) is reported as an average of carries or total distances on five hits. The results are shown in Table 2. The hitting machine used was a hitting machine by True Temper Corp. The club used was Tour Stage V700 (Bridgestone Sports Co., Ltd.) with loft 11°, shaft Harmotech Lite HM50J (HK), hardness S, and balance D2.

TABLE 2

| | Example | | | Comparative Example |
|---|---|---|---|---|
| | 1 | 2 | 3 | 1 |
| Carry (m) | 220 | 218 | 219.5 | 217 |
| Total (m) | 240 | 237 | 238.5 | 236.5 |

Japanese Patent Application No. 2003-114261 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball having on its outer surface a multiplicity of dimples which are generally circular as viewed in plane and which each have a center and a peripheral rim, wherein the number of those dimples having a neighbor relationship provided that a reference dimple is arbitrarily selected from the multiplicity of dimples and an adjacent dimple is disposed adjacent to the reference dimple, an angle α included between two line segments drawn from the center of the adjacent dimple tangent to the rim of the reference dimple and an angle β included between two line segments drawn from the center of the reference dimple tangent to the rim of the adjacent dimple satisfy $|\alpha-\beta| \geqq 15°$ is at least 60% of the total number of dimples.

2. The golf ball of claim 1 wherein the number of those dimples having a neighbor relationship that the linear distance between the center of the reference dimple and the center of the adjacent dimple is at least 4 mm is at least 80% of the total number of dimples.

3. The golf ball of claim 1 wherein there are dimples of at least three types which differ in size.

4. The golf ball of claim 1 wherein the number of those dimples whose rim has a peripheral length of at least 13 mm is at least 70% of the total number of dimples.

5. A method of forming on the outer surface of a golf ball a multiplicity of dimples which are generally circular as viewed in plane and which each have a center and a peripheral rim, said method comprising designing and arranging the dimples such that the number of those dimples having a neighbor relationship provided that a reference dimple is arbitrarily selected from the multiplicity of dimples and an adjacent dimple is disposed adjacent to the reference dimple, an angle α included between two line segments drawn from the center of the adjacent dimple tangent to the rim of the reference dimple and an angle β included between two line segments drawn from the center of the reference dimple tangent to the rim of the adjacent dimple satisfy $|\alpha-\beta| \geqq 15°$ is at least 60% of the total number of dimples.

6. The method of claim 5 wherein the dimples are designed and arranged such that the number of those dimples having a neighbor relationship that the linear distance between the center of the reference dimple and the center of the adjacent dimple is at least 4 mm is at least 80% of the total number of dimples.

7. The method of claim 5 wherein there are dimples of at least three types which differ in size.

8. The method of claim 5 wherein the dimples are designed and arranged such that the number of those dimples whose rim has a peripheral length of at least 13 mm is at least 70% of the total number of dimples.

* * * * *